US009246239B2

(12) United States Patent
Inoue et al.

(10) Patent No.: US 9,246,239 B2
(45) Date of Patent: Jan. 26, 2016

(54) CRIMPED TERMINAL WIRE FOR AUTOMOBILE

(75) Inventors: Akiko Inoue, Yokkaichi (JP); Takehiro Hosokawa, Yokkaichi (JP); Yasuyuki Otsuka, Yokkaichi (JP); Fumitoshi Imasato, Yokkaichi (JP); Tetsuya Nakamura, Yokkaichi (JP); Shigeyuki Tanaka, Yokkaichi (JP); Yutaka Takata, Yokkaichi (JP); Yoshiaki Yamano, Yokkaichi (JP); Kazunari Sakura, Yokkaichi (JP); Naoya Nishimura, Yokkaichi (JP); Takaaki Ito, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 133 days.

(21) Appl. No.: 13/877,588

(22) PCT Filed: Aug. 16, 2011

(86) PCT No.: PCT/JP2011/068541
§ 371 (c)(1),
(2), (4) Date: Apr. 3, 2013

(87) PCT Pub. No.: WO2012/053275

PCT Pub. Date: Apr. 26, 2012

(65) Prior Publication Data

US 2013/0199842 A1 Aug. 8, 2013

(30) Foreign Application Priority Data

Oct. 22, 2010 (JP) ..... 2010-236967

(51) Int. Cl.
*H01R 4/18* (2006.01)
*H01R 4/62* (2006.01)

(Continued)

(52) U.S. Cl.
CPC ..... *H01R 4/18* (2013.01); *H01R 4/185* (2013.01); *H01R 4/62* (2013.01); *H01R 4/70* (2013.01); *H01R 13/5216* (2013.01); *H01R 2201/26* (2013.01)

(58) Field of Classification Search
USPC ..... 439/730, 189; 174/84 C, 84
See application file for complete search history.

(56) References Cited

U.S. PATENT DOCUMENTS 3,143,545 A * 8/1964 Lowrie ..... C07D 279/10 544/52
3,143,595 A * 8/1964 Martin ..... 174/84 C (Continued)

FOREIGN PATENT DOCUMENTS

CN 101394025 A 3/2009
EP 2 597 728 A1 5/2013

(Continued)

OTHER PUBLICATIONS

Jul. 1, 2014 Office Action issued in Japanese Patent Application No. 2010-236967 (with translation).

(Continued)

*Primary Examiner* — William H Mayo, III
*Assistant Examiner* — Krystal Robinson
(74) *Attorney, Agent, or Firm* — Oliff PLC

(57) ABSTRACT

A crimped terminal for automobiles includes an aluminum electric wire, a connecting terminal made from a copper-based material, and a resin-coated portion. The connecting terminal is crimped onto an end of the wire and includes a crimped member, a crimped portion where the terminal is crimped onto the wire, and the resin-coated portion disposed on the crimped portion, wherein the resin-coated portion is disposed on the crimped portion while an entire periphery of the crimped portion is coated with the resin-coated portion.

20 Claims, 3 Drawing Sheets

1

(51) Int. Cl.
*H01R 4/70* (2006.01)
*H01R 13/52* (2006.01)

(56) References Cited

U.S. PATENT DOCUMENTS

| | | | | |
|---|---|---|---|---|
| 4,304,616 | A * | 12/1981 | Richardson | 156/86 |
| 4,390,745 | A * | 6/1983 | Bottcher et al. | 174/73.1 |
| 5,801,332 | A * | 9/1998 | Berger et al. | 174/73.1 |
| 6,613,263 | B2 * | 9/2003 | Kondo | H01R 11/12 264/263 |
| 7,174,633 | B2 * | 2/2007 | Onuma | H01R 4/04 29/854 |
| 2001/0003688 | A1 | 6/2001 | Kondo | |
| 2002/0127915 | A1 | 9/2002 | Kondo | |

FOREIGN PATENT DOCUMENTS

| | | | |
|---|---|---|---|
| JP | A-11-121075 | | 4/1999 |
| JP | A-2001-167640 | | 6/2001 |
| JP | A-2002-315130 | | 10/2002 |
| JP | 2003297447 | A * | 10/2003 |
| JP | A-2003-297447 | | 10/2003 |
| JP | A-2010-108798 | | 5/2010 |
| JP | A-2010-108828 | | 5/2010 |
| JP | 2010-165430 | A | 7/2010 |
| JP | A-2010-177134 | | 8/2010 |
| JP | A-2010-238393 | | 10/2010 |
| WO | WO 2011/035084 | A1 | 3/2011 |

OTHER PUBLICATIONS

Extended European Search Report issued in European Patent Application No. 11834117.1 on Feb. 25, 2014.
Oct. 25, 2011 International Search Report issued in International Application No. PCT/JP2011/068541.
Nov. 21, 2014 Office Action from Chinese Patent Application No. 201180050948.2.
Japanese Office Action issued in Japanese Patent Application No. 2010-236967 on Sep. 9, 2014 (with translation).
Jun. 8, 2015 Office Action issued in European Application No. 11 834 117.1.
Jul. 15, 2015 Office Action issued in Chinese Application No. 201180050948.2.
Nov. 4, 2015 Office Action issued in Chinese Patent Application No. 201180050948.2.

* cited by examiner

CRIMPED TERMINAL WIRE FOR AUTOMOBILE

TECHNICAL FIELD

The present invention relates to a crimped terminal wire for automobile that includes an aluminum electric wire, and a connecting terminal that is crimped onto the end of the aluminum electric wire.

BACKGROUND ART

In the field of electric power industry, aluminum electric wires, which include conductor wires made from aluminum-based materials that are light in weight and excellent in electrical conductivity, are conventionally used as overhead power lines. Meanwhile, in the field of automobile industry, copper electric wires, which include conductor wires made from copper-based materials that are excellent in electrical conductivity and in cost efficiency, are conventionally used as signal lines and electric power lines.

In these years, electric vehicles and fuel-cell vehicles that can put a reduced burden on the environment have been developed actively in the field of automobile industry. In these kinds of vehicles, electric power lines larger in diameter than conventional signal lines should be used as electric wires connected to batteries and fuel cells because large amounts of electric power need to be transmitted from the batteries and the fuel cells.

Meanwhile, a move to improve fuel efficiency by reducing the weight of automotive vehicles has been accelerated in the field of automobile industry, so that even the total weight of electric wires used in one automotive vehicle cannot be overlooked, and weight reduction of the electric wires is also desired.

Thus, aluminum electric wires, which include conductor wires made from aluminum having a specific gravity (2.70 $g/cm^3$) that is about one third of copper (8.96 $g/cm^3$), have been more often used in automobiles in order to reduce the total weight of electric wires.

Conventionally, connecting terminals arranged to connect electric wires with each other, or connect electric wires with terminals of external electronic appliances are used in routing any kinds of electric wires, i.e., not exclusively to routing aluminum electric wires. Most of the connecting terminals are made from copper-based materials from the viewpoints of electrical conductivity and cost efficiency.

The connecting terminals made from copper-based materials are often used also in routing aluminum electric wires in automotive vehicles, so that crimped terminal portions where the connecting terminals are crimped onto the aluminum electric wires define bimetal contact portions. For example, in using connecting terminals made from copper, the difference between the normal electrode potential of copper, which is +0.34 V, and the normal electrode potential of aluminum, which is −1.66 V, becomes 2.00 V, which is large. In addition, in using connecting terminals made from copper that are coated with tin plating, the difference between the normal electrode potential of tin, which is −0.14 V, and the normal electrode potential of aluminum becomes 1.52 V. Thus, if the crimped terminal portions are exposed to water while the vehicles are moving in the rain or washed, or because of condensation, and an electrolyte solution such as rain water enters to stay in the crimped terminal portions, the three members of aluminum, copper and electrolyte solution, or the three members of aluminum, tin and electrolyte solution form batteries, so that bimetallic corrosion builds up in the aluminum conductors that function as positive electrodes of the batteries.

When ionization of the aluminum electric wires, which are electrically base, proceed to promote the corrosion as described above, the contact states of the crimped terminal portions become worse, which could make the electrical characteristics of the crimped terminal portions unstable, could increase contact resistance, could increase electrical resistance because of the reduced wire diameters, and could break the electric wires. Consequently, the electrical components could malfunction, or could break down.

PTL 1 discloses, in order to prevent corrosion from building up in an aluminum electric wire having the configuration described above, a manner for preventing a factor (corrosion factor) such as water and oxygen that causes the corrosion from entering in a bimetal contact portion by coating a portion where an aluminum conductor wire is exposed in a crimped terminal portion with an anticorrosive resin.

CITATION LIST

Patent Literature

PTL 1: Patent JP 2010-108798

SUMMARY OF INVENTION

Technical Problem

However, while the anticorrosion manner by coating the portion where the aluminum conductor wire is exposed with the anticorrosive agent is easy to use, corrosion could build up in the connecting terminal itself under harsh circumstances. The corrosion built up in the connecting terminal causes a problem that crevice corrosion proceeds between the anticorrosive resin and the connecting terminal to reach the bimetal contact portion where the aluminum electric wire is in contact with the connecting terminal, which significantly promotes corrosion of the aluminum.

Especially in the case of using a generally-used connecting terminal made from a copper-based material, which is produced by stamping out a copper plate of which a surface is coated with tin plating, and which includes a cutting face on which the copper is exposed because no tin plating is applied thereon, corrosion easily builds up in the tin, which is electrically base, at a bimetal contact portion where the copper-exposed portion is in contact with the plated tin because the normal electrode potential of copper is +0.34 V while the normal electrode potential of tin is −0.14 V. When corrosion builds up in the outermost coat of the connecting terminal that is coated with tin plating to reach the resin portion, crevice corrosion proceeds in a crevice between the plated tin and the resin to easily reach the bimetal contact portion between the aluminum electric wire and the connecting terminal.

In this case, if the crevice corrosion that proceeds in the crevice between the connecting terminal and the resin can be inhibited from reaching the bimetal contact portion between the aluminum electric wire and the connecting terminal, corrosion can be prevented from building up in the aluminum electric wire. However, it has not been clear previously how far the crevice corrosion proceeds in the crevice between the connecting terminal and the resin. For this reason, it has not been found in which range a resin-coated portion should be provided in order to inhibit the crevice corrosion from reaching the bimetal contact portion between the aluminum electric wire and the connecting terminal.

The present invention is made in view of the problems described above, and an object of the present invention is, by determining how far crevice corrosion proceeds in a crevice between a connecting terminal made from a copper-based material and a resin (in particular, an organic resin) in an automobile environment, to provide a crimped terminal wire for automobile that includes an aluminum electric wire, a connecting terminal made from a copper-based material that is crimped onto the end of the aluminum electric wire, and a resin-coated portion that is provided in a range capable of inhibiting the crevice corrosion from reaching a bimetal contact portion between the aluminum electric wire and the connecting terminal.

Solution to Problem

To achieve the objects and in accordance with the purpose of the present invention, a crimped terminal wire for automobile of the present invention includes an aluminum electric wire including an aluminum conductor wire and an insulation with which the aluminum conductor wire is coated, a connecting terminal made from a copper-based material and crimped onto an end of the aluminum electric wire, the connecting terminal including a crimped member that is crimped onto the aluminum electric wire and an electrical contact portion with which the connecting terminal is connected to another terminal, a crimped portion where the connecting terminal is crimped onto the aluminum electric wire, and a resin-coated portion made from a resin, which is disposed on the crimped portion, wherein the resin-coated portion is disposed on the crimped portion while an entire periphery of the crimped portion is coated with the resin-coated portion.

It is preferable that a portion of the resin-coated portion between a top end of the aluminum conductor wire and a top end of the resin-coated portion has a length of 0.3 mm or more. It is more preferable that that the portion of the resin-coated portion between the top end of the aluminum conductor wire and the top end of the resin-coated portion has a length of 1.0 mm or more.

It is preferable that a portion of the resin-coated portion, with which the aluminum conductor wire is coated, has a thickness of 0.01 mm or more, and that a portion of the resin-coated portion, with which a cutting face of the connecting terminal is coated, has a thickness of 0.01 mm or more. It is more preferable that the portion of the resin-coated portion, with which the aluminum conductor wire is coated, has a thickness of 0.1 mm or more, and that the portion of the resin-coated portion, with which the cutting face of the connecting terminal is coated, has a thickness of 0.1 mm or more.

In addition, it is preferable that the resin-coated portion includes a tapered portion at its posterior end portion, which has a shape tapering off to the side of the aluminum electric wire. It is preferable that the tapered portion of the resin-coated portion has a rising angle of 45 degrees or less, and more preferable that the tapered portion of the resin-coated portion has a rising angle of 30 degrees or less. It is preferable that the tapered portion of the resin-coated portion has a length of 1 mm or more, and more preferable that the tapered portion of the resin-coated portion has a length of 2 mm or more.

Advantageous Effects of Invention

Having the configuration that the entire periphery of the crimped portion is coated with the resin-coated portion, which is made from the resin and disposed on the crimped portion where the connecting terminal is crimped onto the aluminum electric wire, the crimped terminal wire for automobile of the present invention is capable of preventing a corrosion factor from easily reaching the bimetal contact port ion between the aluminum electric wire and the connecting terminal. Thus, being capable of preventing corrosion from building up in the aluminum conductor wire, the crimped terminal wire for automobile of the present invention has a stable anticorrosion property.

DESCRIPTION OF EMBODIMENTS

Figure 1:
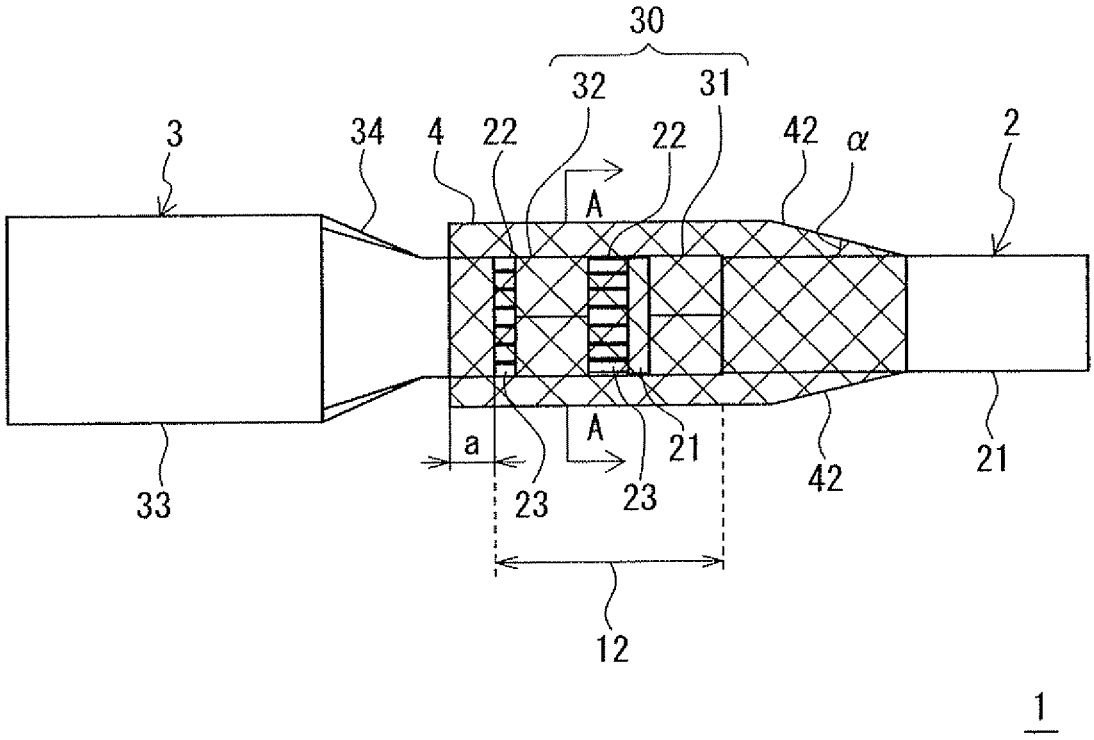
FIG. 1 is a plan view showing one example of a crimped terminal wire of the present invention.
Figure 2:
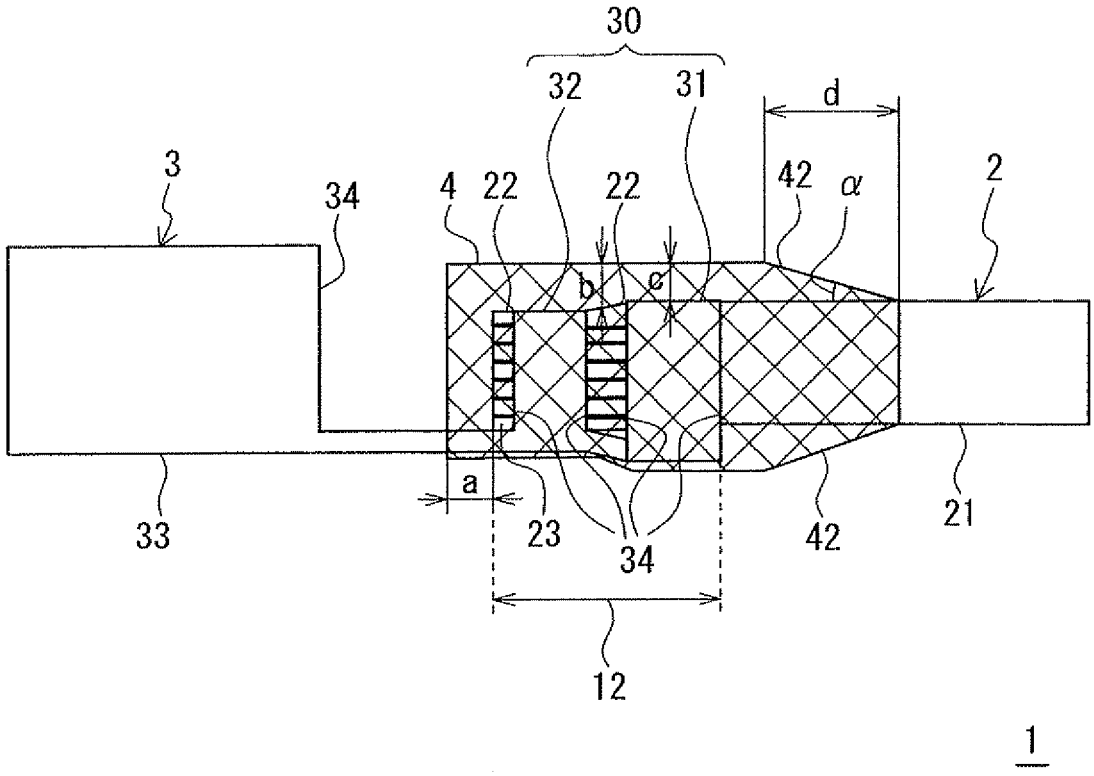
FIG. 2 is a side view showing the crimped terminal wire shown in FIG. 1.
Figure 3:
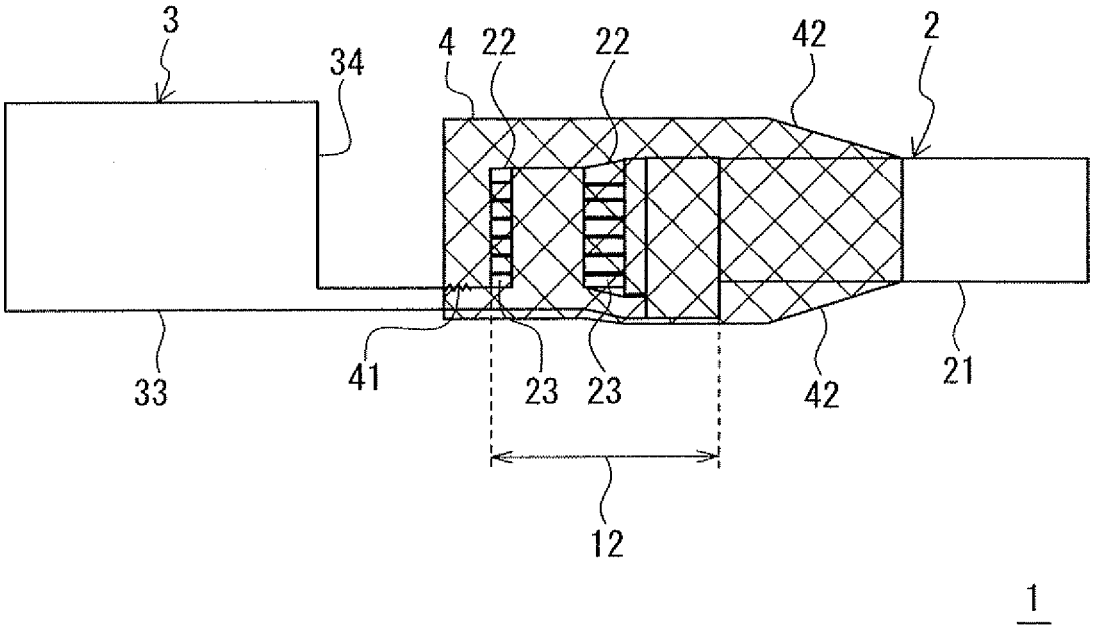
FIG. 3 is a view showing crevice corrosion proceeding in a crevice between a connecting terminal and a resin-coated portion shown in FIG. 2.
Figure 4:
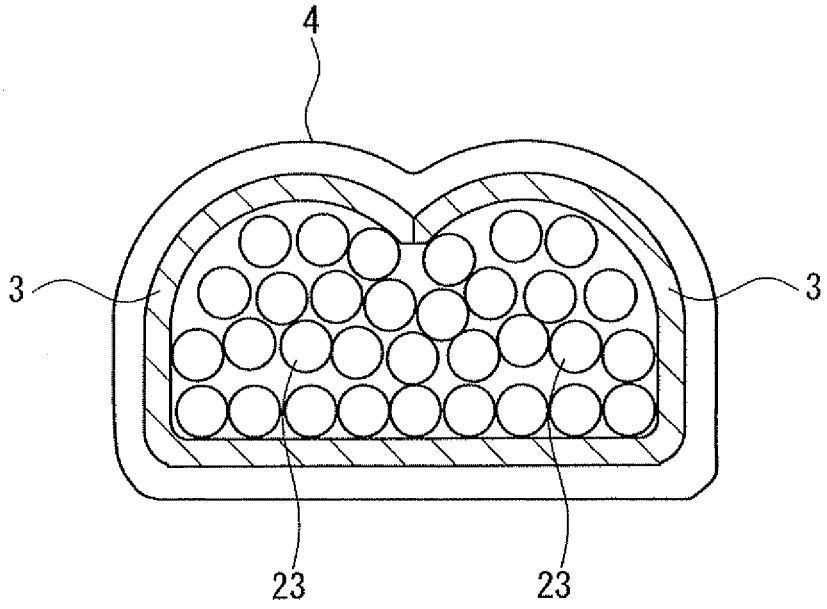
FIG. 4 is a cross-sectional view, showing the crimped terminal wire along the line A-A of FIG. 1.

A detailed description of one preferred embodiment of the present invention will now be provided with reference to the accompanying drawings. FIG. 1 is a plan view showing one example of a crimped terminal wire for automobile of the present invention. FIG. 2 is a side view showing the crimped terminal wire shown in FIG. 1. FIG. 3 is a view showing crevice corrosion proceeding in a crevice between a connecting terminal and a resin-coated portion shown in FIG. 2. FIG. 4 is a cross-sectional view showing the crimped terminal wire along the line A-A of FIG. 1. The top of FIG. 2 is referred to as the front face side of the crimped terminal wire, and the bottom of FIG. 2 is referred to as the bottom face side of the crimped terminal wire. The top and bottom of FIG. 1 are referred to as the lateral face sides of the crimped terminal wire.

A crimped terminal wire 1 for automobile (hereinafter, referred to also as a crimped terminal wire 1) of the present invention includes an aluminum electric wire 2, a connecting terminal 3 made from a copper-based material and crimped onto the end of the aluminum electric wire 2, and a crimped portion 12 where the connecting terminal 3 is crimped onto the aluminum electric wire 2 as shown in FIGS. 1 to 4. The crimped terminal wire 1 further includes a resin-coated portion 4 made from a resin, which is disposed on the crimped portion 12. While FIGS. 1 to 3 are views showing the external view of the crimped terminal wire 1, the components below the resin-coated portion 4 are shown in FIGS. 1 to 3 through the resin-coated portion 4, which is defined by the diagonally shaded areas in FIGS. 1 to 3, for the sake of illustration.

The aluminum electric wire 2 includes a plurality of aluminum conductor wires 23, and an insulation with which the aluminum conductor wires 23 are coated. The aluminum electric wire 2 consists of an insulation-coated portion 21 where the aluminum conductor wires 23 are coated with the insulation, and a conductor-wire portion 22 where the insulation is peeled away from the end of the aluminum electric wire 2 to expose the aluminum conductor wires 23.

The connecting terminal 3 shown in FIGS. 1 and 2 is made from a copper alloy, a surface of which is coated with tin plating. The connecting terminal 3 is produced by stamping a copper alloy plate that is coated with tin plating so as to have a predetermined shape, and then pressing to bend it so as to have a terminal shape. Thus, a cutting face 34 of the connecting terminal 3, which is produced by stamping the plate, is not coated with tin plating. The connecting terminal 3 shown in FIGS. 1 and 2 includes an end face that defines the cutting face 34.

The connecting terminal 3 includes a crimped member 30 that is crimped onto the aluminum electric wire 2, and an electrical contact portion 33 with which the connecting terminal 3 is connected to another terminal. The crimped member 30 includes a wire barrel 32 that is crimped onto the conductor-wire port ion 22 of the aluminum electric wire 2, and an insulation barrel 31 that is at a given distance from the wire barrel 32 and crimped onto the insulation-coated portion 21 of the aluminum electric wire 2. The insulation barrel 31 and the wire barrel 32 are connected to each other to be of a monolithic construction on the bottom face of the crimped member 30. The crimped member 30 of the connecting terminal 3 includes clearances provided on its lateral faces and its top face between the insulation barrel 31 and the wire barrel 32 after crimped onto the aluminum electric wire 2. The electrical contact portion 33 defines a female component having a box shape so as to be fitted into a male connecting terminal (not shown).

In the crimped terminal wire 1, the insulation barrel 31 is crimped onto the insulation-coated portion 21 of the aluminum electric wire 2 and the wire barrel 32 is crimped onto the conductor-wire portion 22 of the aluminum electric wire 2, whereby the crimped portion 12 is provided as shown in FIGS. 1 and 2. Further, the resin-coated portion 4 made from the resin is provided on the crimped portion 12 while the entire periphery of the crimped portion 12 is coated with the resin-coated portion 4. The resin-coated portion 4 is preferably made from an organic resin such as a polyimide resin and a polyolefin resin.

In the present invention, "the crimped portion 12" defines a portion corresponding to the crimped member 30 including the insulation barrel 31 and the wire barrel 32 that are crimped onto the aluminum electric wire 2. To be specific, "the crimped portion 12" in the present invention defines a portion between the front top ends of the aluminum conductor wires 23 and the posterior end of the insulation barrel 31 as shown in FIGS. 1 and 2. In the present invention, the longitudinal direction of the crimped terminal wire 1 is referred to as a back/forth direction, and the side of the crimped terminal wire 1, at which the crimped terminal wire 1 is connected to another terminal, is referred to as the front side for the sake of illustration.

In addition, in the present invention, "the entire periphery" of the crimped portion 12 defines a portion including the periphery in the lateral direction of the crimped portion 12, front top end portions of the aluminum conductor wires 23, the outer surfaces of the insulation barrel 31 and the wire barrel 32, and end faces in the back/forth direction of the insulation barrel 31 and the wire barrel 32 (the cutting face produced by stamping). To be specific, the resin-coated portion 4 is provided on the crimped portion 12 while an outer peripheral surface of the crimped portion 12, the outer peripheral surface being longer in the back/forth direction than the crimped portion 12, is coated with the resin-coated portion 4.

A portion of the insulation-coated portion 21 and a portion of the aluminum conductor wires 23 are exposed from the clearances between the insulation barrel 31 and the wire barrel 32 on the lateral faces and the top face of the crimped portion 12, so that the portion of the aluminum conductor wires 23 is not covered by the connecting terminal 3. In addition, end portions of the aluminum conductor wires 23 lie off the front end of the wire barrel 32 to the side of the electrical contact portion 33 in the crimped portion 12. The portions of the aluminum conductor wires 23 that are not covered by the connecting terminal 3 are coated with the resin-coated portion 4, so that the aluminum conductor wires 23 are not exposed to the outside.

The configuration that the resin-coated portion 4 made from the resin is disposed on the crimped portion 12 while the entire periphery of the crimped portion 12 is coated with the resin coat is capable of preventing rain water from entering the crimped portion 12. The configuration that the outer peripheral surface that is longer in the back/forth direction than the crimped portion 12 is coated with the resin-coated portion 4 while the entire periphery of the crimped portion 12 is coated with the resin-coated portion 4 is capable of inhibiting, for a long period of time, a corrosion factor from entering the crimped portion 12, which is described later. In particular, even if crevice corrosion 41 proceeds in a crevice between the connecting terminal 3 and the resin-coated portion 4 as shown in FIG. 3, this configuration is capable of inhibiting, for a long period of time, the crevice corrosion 41 from reaching a bimetal contact portion where the connecting terminal 3 is in contact with the aluminum conductor wires 23. That is, the crimped terminal wire 1 is capable of preventing, for a long period of time, corrosion from building up in the aluminum conductor wires 23, and thus has a stable anti-corrosion property.

Corrosion builds up in the tin at a portion of the connecting terminal 3, the portion being not coated with the resin-coated portion 4, whereby the tin is eluted. A bimetal contact portion where the tin is in contact with the copper is exposed, and if the bimetal contact portion is exposed to water, the corrosion of the tin, which is electrically base, significantly proceeds, and reaches the resin-coated portion 4. The crevice corrosion 41 could proceed in the crevice between the electrical contact portion 33 of the connecting terminal 3 and the resin-coated portion 4 to reach the bimetal contact portion where the connecting terminal 3 is in contact with the aluminum conductor wires 23. When the crevice corrosion 41 reaches the bimetal contact portion between the connecting terminal 3 and the aluminum conductor wires 23, corrosion significantly proceeds to build up in the aluminum conductor wires 23. In particular, the connecting terminal 3 includes a bimetal contact portion where the cutting face 34 where the copper is exposed from the first is in contact with the tin plated on the surface of the connecting terminal 3, so that corrosion that builds up in the cutting face 34 exerts a large influence.

The length of a portion a of the resin-coated portion 4 between the top ends of the aluminum conductor wires 23 and the top end of the resin-coated portion 4, which is shown in FIGS. 1 and 2, is preferably 0.3 mm or more, and more preferably 1.0 mm or more. This configuration allows the portion between the top ends of the aluminum conductor wires 23 and the top end of the resin-coated portion 4 to have a length enough to prevent the crevice corrosion 41 that proceeds in the crevice between the resin-coated portion 4 and the connecting terminal 3 from easily reaching the bimetal contact portion between the aluminum conductor wires 23 and the connecting terminal 3.

In addition, the thickness of a portion (indicated with a reference character b in FIG. 2) of the resin-coated portion 4, with which the aluminum conductor wires 23 are coated, is preferably 0.01 mm or more. This configuration is capable of preventing a corrosion factor from getting into the resin-coated portion 4 to be in contact with the aluminum conductor wires 23 even when a fine defect such as a flaw is produced on the surface of the resin-coated portion 4. The thickness of a portion of the resin-coated portion 4, with which the aluminum conductor wires 23 are coated, is more preferably 0.1 mm or more. This configuration is capable of preventing a corrosion factor from getting into the resin-coated portion 4 even when a larger flaw is produced on the surface of the resin-coated portion 4. Thus, having this configuration, the crimped terminal wire 1 for automobile is capable of more effectively preventing corrosion.

In addition, the thickness of a portion (indicated with a reference character c in FIG. 2) of the resin-coated portion 4, with which the cutting face of the connecting terminal 3 is coated, is preferably 0.01 mm or more. This configuration is capable of preventing a corrosion factor from getting into the resin-coated portion 4 to be in contact with the cutting face of the connecting terminal 3 even when a fine defect such as a flaw is produced on the surface of the resin-coated portion 4. The thickness of a portion of the resin-coated portion 4, with which the cutting face of the connecting terminal 3 is coated, is more preferably 0.1 mm or more. This configuration is capable of preventing a corrosion factor from getting into the resin-coated portion 4 even when a larger flaw is produced on the surface of the resin-coated portion 4. Thus, having this configuration, the crimped terminal wire 1 for automobile is capable of more effectively preventing corrosion.

In addition, the resin-coated portion 4 preferably includes a tapered portion 42 at its posterior end portion, which has the shape tapering off to the side of the aluminum electric wire 2. The tapered portion 42 is disposed on the insulation-coated portion 21. The inclusion of the tapered portion 42 prevents the resin coat of the resin-coated portion 4 from being easily pee led away from the aluminum electric wire 2 when the crimped terminal wire 1 is bent. Consequently, this configuration is capable of preventing a corrosion factor from getting into a crevice between the resin-coated portion 4 and the aluminum electric wire 2, whereby the aluminum conductor wires 23 have their anticorrosion properties maintained. In this case, the tapered portion 42 preferably has a rising angle $\alpha$ of 45 degrees or less. This configuration is capable of more effectively preventing the resin coat of the resin-coated portion 4 from being peeled away from the aluminum electric wire 2. The tapered portion 42 more preferably has a rising angle $\alpha$ of 30 degrees or less. This configuration is capable of preventing the resin coat of the resin-coated portion 4 from being peeled away from the aluminum electric wire 2 even when the crimped terminal wire 1 is bent at a larger bending angle, or bent repeatedly.

The tapered portion 42 of the resin-coated portion 4 preferably has a length d of 1 mm or more. Even when the resin coat of the resin-coated portion 4 is peeled away slightly from the aluminum electric wire 2, this configuration is capable of preventing the peel from easily reaching the crimped portion 12, and is thus capable of effectively preventing a corrosion factor from getting into the crimped portion 12. That is, the crimped terminal wire 1 having this configuration has a stable anticorrosion property. The tapered portion 42 of the resin-coated portion 4 more preferably has a length d of 2 mm or more. This configuration is capable of more effectively preventing a corrosion factor from getting into the crimped portion 12.

Examples of a method for producing the resin-coated portion 4 include a molding method by injecting a resin in an appropriate die in which a crimped terminal wire is placed, and a molding method by dropping a molten resin on an appropriate site.

In producing the resin-coated portion 4, the length of the portion between the top ends of the aluminum conductor wires 23 and the top end of the resin-coated portion 4, the thickness of the resin coat, and the length and the angle of the tapered portion 42 of the resin coat can be adjusted by using a molding method by injecting a resin in an appropriate die, or a molding method by dropping a generous amount of molten resin and then scraping excess off after the resin is solidified.

EXAMPLE

Hereinafter, Examples of the present invention, and Comparative Examples are presented.

Example 1

Samples No. 1 to 16

Crimped terminal wires 1 of samples 1 to 16 of Example 1 were prepared as follows: the crimped terminal wires 1 were prepared, each of which included a connecting terminal 3, which defined a 090 female connecting terminal, an aluminum electric wire 2, which defined an aluminum electric wire 0.75 $mm^2$ or 2.5 $mm^2$ in diameter, and a resin-coated portion 4, which was made from a polyamide resin (manuf.: HENKEL JAPAN LTD., trade name: "MACROMELT 6202"), such that the lengths a of the portions between the top ends of the aluminum conductor wires 23 and the top ends of the resin-coated portions 4, the thicknesses b of the portions of the resin-coated portions 4 with which the upper sides of the conductor-wire portions 22 were coated, and the thicknesses c of the portions of the resin-coated portions 4 with which the cutting faces of the connecting terminals 3 were coated, which were shown in FIG. 1, were varied among the crimped terminal wires 1. Corrosion tests (JIS C 0023) were carried out on the crimped terminal wires 1 of samples 1 to 16. The test time of each corrosion test was set to be twenty-four hours. After picking up the crimped terminal wires 1 of samples 1 to 16 from a neutral salt spray apparatus, the crimped terminal wires 1 of samples 1 to 16 were checked for corrosion by visual external observation. This process was counted as one cycle, and repeated again if no corrosion built up in the crimped terminal wires 1 of samples 1 to 16. Results of the corrosion tests are presented in Table 1 as the numbers of cycles when corrosion built up.

Comparative Examples 1, 2

Crimped terminal wires 1 of Comparative Examples 1, 2 were prepared as follows in a similar manner to the crimped terminal wires 1 of Example 1 described above except that the cutting faces of the connecting terminals 3 were not coated with a resin while the resin-coated portions 4 were provided only on the conductor-wire portions 22 of the crimped portions 12. Corrosion tests were carried out on the crimped terminal wires 1 of Comparative Examples 1, 2. Results of the corrosion tests carried out on the crimped terminal wires 1 of Comparative Examples 1, 2 are presented in Table 1.

TABLE 1

| Sample No. | Wire diameter ($mm^2$) | Length between aluminum conductor wire top end to resin-coated portion top end a (mm) | Thickness of resin-coated portion coating aluminum conductor wires b (mm) | Thickness of resin-coated portion coating cutting face of connecting terminal c (mm) | Cycle number when corrosion built up |
|---|---|---|---|---|---|
| 1 | 0.75 | 1.0 | 0.1 | 0.1 | 11 |
| 2 | 0.75 | 0.3 | 0.1 | 0.1 | 4 |
| 3 | 0.75 | 0.2 | 0.1 | 0.1 | 2 |
| 4 | 0.75 | 1.0 | 0.01 | 0.1 | 6 |
| 5 | 0.75 | 1.0 | 0.005 | 0.1 | 2 |
| 6 | 0.75 | 1.0 | 0.1 | 0.01 | 6 |
| 7 | 0.75 | 1.0 | 0.1 | 0.005 | 3 |
| 8 | 0.75 | 1.3 | 2.4 | 1.7 | 15 |
| 9 | 2.5 | 1.0 | 0.1 | 0.1 | 10 |
| 10 | 2.5 | 0.3 | 0.1 | 0.1 | 4 |
| 11 | 2.5 | 0.2 | 0.1 | 0.1 | 2 |
| 12 | 2.5 | 1.0 | 0.01 | 0.1 | 5 |
| 13 | 2.5 | 1.0 | 0.005 | 0.1 | 2 |
| 14 | 2.5 | 1.0 | 0.1 | 0.01 | 6 |
| 15 | 2.5 | 1.0 | 0.1 | 0.005 | 3 |
| 16 | 2.5 | 1.3 | 1.03 | 0.4 | 14 |
| Comparative Example 1 | 0.75 | 0.3 | 1.00 | 0 | 1 |
| Comparative Example 2 | 2.5 | 0.3 | 1.00 | 0 | 1 |

As is evident from Table 1, the crimped terminal wires 1 of the samples 1 to 16 of Example 1 that have the configurations that the entire peripheries of the crimped portions 12 are coated with the resin-coated portions 4 are capable of resisting the corrosion environment for a long period of time compared with the crimped terminal wires 1 of Comparative Examples 1, 2 that have configurations that the entire peripheries of the crimped portions 12 are not coated with the resin-coated portions 4. In addition, the crimped terminal wires 1 of the samples 1 to 16 of Example 1 that have the configurations that the lengths of the portions between the top ends of the aluminum conductor wires 23 and the top ends of the resin-coated portions 4 are larger are capable of preventing the crevice corrosions 41 from easily reaching the bimetal contact portions between the aluminum conductor wires 23 and the connecting terminals 3. Thus, the crimped terminal wires 1 of the samples 1 to 16 of Example 1 are capable of resisting the corrosion environment for a long period of time.

Example 2 Samples No. 17 to 30

Next, crimped terminal wires 1 of samples 17 to 30 of Example 2 were prepared. The crimped terminal wires 1 of samples 17 to 28 were provided with the resin-coated portions 4 including tapered portions 42 at their posterior end portions. The crimped terminal wires 1 of samples 29, 30 were provided with the resin-coated portions 4 including no tapered portion 42. Bending tests were carried out on the crimped terminal wires 1 of samples 17 to 30. After the tests, the crimped terminal wires 1 of samples 17 to 30 were checked as to the degrees of peeling of the resin coats of the resin-coated portions 4 from the aluminum electric wires 2. The lengths of the tapered portions 42 were expressed as d, and the rising angles of the tapered portions 42 were expressed as α. The crimped terminal wires 1 were bent while held at the portions that were three centimeters behind the posterior ends of the insulation barrels 31 and the electrical contact portions 33 of the connecting terminals 3, where bending ninety degrees in the crimping face direction and then ninety degrees in the opposite direction was counted as one bending time. The numbers of bending times when peeling of the resin coats of the resin-coated portions 4 that reached the insulation barrels 31 were produced were counted. The crimped terminal wires 1 of samples 17 to 30 were checked for peeling of the resin coats by visual observation. In Example 2, the lengths a of the portions between the top ends of the aluminum conductor wires 23 and the top ends of the resin-coated portions 4 were 1 mm, the thicknesses b of the portions of the resin-coated portions 4, with which the upper sides of the conductor-wire portions 22 were coated, were 0.1 mm, and the thicknesses c of the portions of the resin-coated portions 4, with which the cutting faces of the connecting terminals 3 were coated, were 0.1 mm.

TABLE 2

| Sample No. | Wire diameter ($mm^2$) | Tapered portion angle α(°) | Tapered portion length d(mm) | Bending-time number when peeling reached insulation barrel |
|---|---|---|---|---|
| 17 | 0.75 | 30 | 2 | 15 |
| 18 | 0.75 | 30 | 1 | 12 |
| 19 | 0.75 | 30 | 0.8 | 10 |
| 20 | 0.75 | 45 | 2 | 12 |
| 21 | 0.75 | 60 | 2 | 10 |
| 22 | 0.75 | 40 | 2 | 13 |
| 23 | 2.5 | 30 | 2 | 9 |
| 24 | 2.5 | 30 | 1 | 6 |
| 25 | 2.5 | 30 | 0.8 | 4 |
| 26 | 2.5 | 45 | 2 | 5 |
| 27 | 2.5 | 60 | 2 | 3 |
| 28 | 2.5 | 11 | 2 | 13 |
| 29 | 0.75 | 90 | 1.00* | 1 |
| 30 | 2.5 | 90 | 1.00* | 1 |

*The length of the tapered portion between the posterior end of the insulation barrel and the posterior end of the resin-coated portion As is evident from Table 2, the configurations that the resin-coated portions 4 include the tapered portions 42 at their posterior end portions are capable of preventing crevices from easily being formed between the resin-coated portions 4 and the aluminum electric wires 2 even when the crimped terminal wires 1 of Example 2 are bent. That is, these configurations are capable of preventing a corrosion factor from easily reaching the insulation barrels 31 to prevent corrosion from building up from the posterior end portions of the resin-coated portions 4. It is shown that as the lengths of the tapered portions are larger, the resin coats of the resin-coated portions 4 are less easily peeled away from the aluminum electric wires 2. It is also shown that as the rising angles α of the tapered portions are smaller, the resin-coated portions 4 are less easily peeled away from the insulation-coated portions 21 of the aluminum electric wires 2.

The foregoing description of the preferred embodiment of the present invention has been presented for purposes of illustration and description; however, it is not intended to be exhaustive or to limit the present invention to the precise form disclosed, and modifications and variations are possible as long as they do not deviate from the principles of the present invention.

The invention claimed is:

1. A crimped terminal wire for an automobile, the wire comprising:

an aluminum electric wire comprising:

an aluminum conductor wire; and an insulation, with which the aluminum conductor wire is coated;

a connecting terminal made from a copper-based material and crimped onto an end of the aluminum electric wire, the connecting terminal comprising:

a crimped member that is crimped onto the aluminum electric wire; and an electrical contact portion, with which the connecting terminal is connected to another terminal;

a crimped portion where the connecting terminal is crimped onto the aluminum electric wire; and a resin-coated portion made from a resin, which is disposed on the crimped portion, wherein the resin-coated portion is disposed on the crimped portion while an entire periphery of the crimped portion is coated with the resin-coated portion, wherein the insulation is an outermost layer of the aluminum conductor wire except in the resin-coated portion, and wherein the resin-coated portion includes a tapered portion at a posterior end portion, the tapered portion has an edge, the tapered portion extends directly from the outermost layer of the aluminum conductor wire and begins at the surface of the outermost layer, and the edge of the tapered portion is an edge of the resin-coated portion.

2. The crimped terminal wire according to claim 1, wherein a portion of the resin-coated portion between a top end of the aluminum conductor wire and a top end of the resin-coated portion has a length of 0.3 mm or more.

3. The crimped terminal wire according to claim 2, wherein the resin-coated portion includes a tapered portion at its posterior end portion, which has a shape tapering off to the side of the aluminum electric wire.

4. The crimped terminal wire according to claim 2, wherein, a portion of the resin-coated portion, with which the aluminum conductor wire is coated, has a thickness of 0.01 mm or more.

5. The crimped terminal wire according to claim 4, wherein the resin-coated portion includes a tapered portion at its posterior end portion, which has a shape tapering off to the side of the aluminum electric wire.

6. The crimped terminal wire according to claim 4, wherein, a portion of the resin-coated portion, with which a cutting face of the connecting terminal is coated, has a thickness of 0.01 mm or more.

7. The crimped terminal wire according to claim 6, wherein the tapered portion extends directly from an outer surface of the outermost layer of the aluminum wire conductor and beyond the outermost layer, and the tapered portion has a shape tapering off to the side of the aluminum electric wire.

8. The crimped terminal wire according to claim 7, wherein the tapered portion of the resin-coated portion has a length of 1 mm or more.

9. The crimped terminal wire according to claim 7, wherein the tapered portion of the resin-coated portion has a rising angle of 45 degrees or less.

10. The crimped terminal wire according to claim 9, wherein the tapered portion of the resin-coated portion has a length of 1 mm or more.

11. The crimped terminal wire according to claim 1, wherein a portion of the resin-coated portion between a top end of the aluminum conductor wire and a top end of the resin-coated portion has a length of 1.0 mm or more.

12. The crimped terminal wire according to claim 1, wherein, a portion of the resin-coated portion, with which the aluminum conductor wire is coated, has a thickness of 0.01 mm or more.

13. The crimped terminal wire according to claim 1, wherein, a portion of the resin-coated portion, with which the aluminum conductor wire is coated, has a thickness of 0.1 mm or more.

14. The crimped terminal wire according to claim 1, wherein, a portion of the resin-coated portion, with which a cutting face of the connecting terminal is coated, has a thickness of 0.01 mm or more.

15. The crimped terminal wire according to claim 1, wherein, a portion of the resin-coated portion, with which a cutting face of the connecting terminal is coated, has a thickness of 0.1 mm or more.

16. The crimped terminal wire according to claim 1, wherein the resin-coated portion includes a tapered portion at its posterior end portion, which has a shape tapering off to the side of the aluminum electric wire.

17. The crimped terminal wire according to claim 16, wherein the tapered portion of the resin-coated portion has a rising angle of 45 degrees or less.

18. The crimped terminal wire according to claim 16, wherein the tapered portion of the resin-coated portion has a rising angle of 30 degrees or less.

19. The crimped terminal wire according to claim 16, wherein the tapered portion of the resin-coated portion has a length of 1 mm or more.

20. The crimped terminal wire according to claim 16, wherein the tapered portion of the resin-coated portion has a length of 2 mm or more.

* * * * *